US009520110B1

(12) United States Patent
Handzic et al.

(10) Patent No.: US 9,520,110 B1
(45) Date of Patent: Dec. 13, 2016

(54) STRING VIBRATION FREQUENCY ALTERING SHAPE

(71) Applicants: Ismet Handzic, Lutz, FL (US); Kyle B. Reed, Tampa, FL (US)

(72) Inventors: Ismet Handzic, Lutz, FL (US); Kyle B. Reed, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 14/753,621

(22) Filed: Jun. 29, 2015

Related U.S. Application Data

(60) Provisional application No. 62/028,037, filed on Jul. 23, 2014.

(51) Int. Cl.
*G10D 3/14* (2006.01)

(52) U.S. Cl.
CPC ..... *G10D 3/143* (2013.01)

(58) Field of Classification Search
CPC ..... G10D 3/10; G10D 3/12; G10D 3/14; G10D 3/143; G10D 3/00; G10D 3/04; G10D 1/08; G10D 1/02; G10D 3/06; G10D 1/00; G10D 1/005; G10D 3/006
USPC ..... 84/297 S, 297 R
See application file for complete search history.

(56) References Cited

U.S. PATENT DOCUMENTS 2,471,534 A 5/1949 Muth et al.

OTHER PUBLICATIONS

Handzic et al., The musical kinetic shape: A variable tension string instrument, Applied Acoustics 85 (2014) 143-149.
Tennenbaum, The Foundations of Scientific Musical Tuning, Fidelio, 1992, vol. 1 No. 1, pp. 47-56.

*Primary Examiner* — Kimberly Lockett
(74) *Attorney, Agent, or Firm* — Nicholas Pfeifer; Smith & Hopen, P.A.

(57) ABSTRACT

The present invention is a novel variable tension string instrument that relies on a kinetic shape to actively alter the tension of a fixed length taut string. A mathematical model was derived that relates the two-dimensional kinetic shape equation to the string's physical and dynamic parameters. With this model, an automated instrument was designed and constructed to play frequencies within predicted and recognizable frequencies along with programmed melodies.

16 Claims, 9 Drawing Sheets

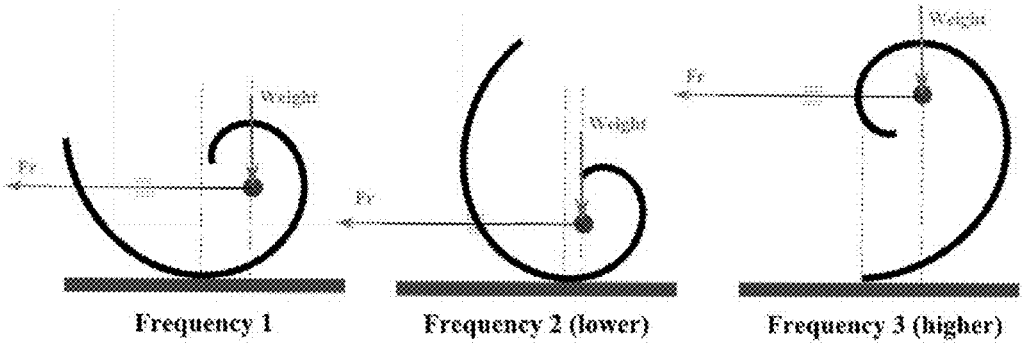
*FIG. 3A* *FIG. 3B* *FIG. 3C*
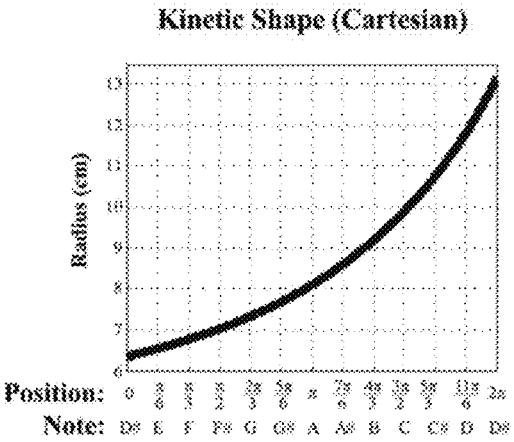
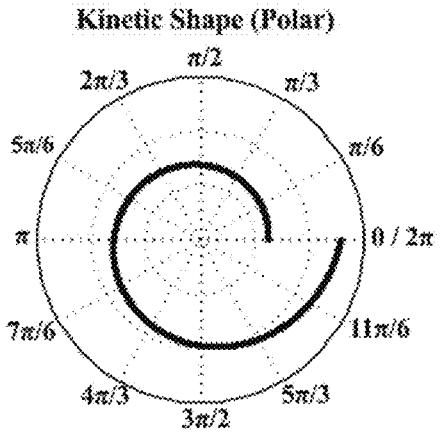
*FIG. 4A* *FIG. 4B*

STRING VIBRATION FREQUENCY ALTERING SHAPE

BACKGROUND OF THE INVENTION

1. Field of the Invention

This invention relates, generally, to string instruments. More specifically, it relates to a variable tension string device.

2. Brief Description of the Prior Art

It is possible to vary the fundamental natural oscillation frequency of a taut and uniform string by either changing the string's length, linear density, or tension. Most string musical instruments produce different tones by either altering string length (fretting) or playing preset and different string gages and string tensions. Although tension can be used to adjust the frequency of a string, it is typically only used in this way for fine-tuning the preset tension needed to generate a specific note frequency.

When plucked, a uniform string in tension will vibrate at some frequency, f. The frequency of a string with uniform mass distribution can be determined by Equation 1 below.

$$f = \left(\frac{1}{2L}\right)\sqrt{\frac{TL}{\mu}} \text{ (Hertz)} \quad (1)$$

L is the length of the stretched string, T is the tension of the string, and μ mass per unit length throughout the string. The equation demonstrates that fundamentally there are three distinct ways of manipulating vibrating string frequency:

1. Change string length (L)—Holding all other factors constant, a shorter string will produce a higher frequency (pitch), while a longer string will produce a lower frequency.
2. Change string tension (T)—Pulling a string with a higher force (tighter) will produce a higher frequency, while loosening the string will produce a lower frequency.
3. Change string unit mass (μ)—A uniformly thicker string will move slower resulting in a lower frequency, while a thinner string produces a higher frequency.

For example, all three strings depicted in FIG. 1 will produce the same vibration frequency. In practice, however, the one parameter most used to vary string vibration frequencies is string length (L).

Almost every string instruments uses the first method in either fretting the string (guitar, violin, etc.), which creates a shorter string and produces a higher frequency (note). Additionally, different notes can be produced by playing different gage (thickness) strings present on the same instrument, such as in the piano. Usually preset string thicknesses are set on the instrument and do not actively change.

Although the string pitch may be altered by stretching, or "bending", the string in stringed instruments such as the guitar, which increases string tension, it is not the explicit way to play these instruments. String tension in stringed instruments is usually adjusted to calibrate, or fine tune, the instrument to a preset and unchanging tension.

The bhapang was the only instrument found that exclusively changes string vibration frequency by changing string tension. The bhapang is a single stringed percussion instrument. The string, which is tightened or loosened by the player with a handle, passes through the drumhead absorbing the drum's vibration as the drum is struck. The player can tighten or loosen the string to produce a continuous variation of sounds. Because of this continuous tension transition of the string, the pitch ramps up or down continuously.

It is also possible to automate and control a stringed musical instrument. This is not new concept and many mechatronic devices have been constructed to do so, however, these devices have been constructed and programmed to play traditional instruments that do not alter the string tension to produce sound.

Accordingly, what is needed is a novel apparatus and method for altering string tension to control its free vibration frequency. However, in view of the art considered as a whole at the time the present invention was made, it was not obvious to those of ordinary skill in the field of this invention how the shortcomings of the prior art could be overcome.

All referenced publications are incorporated herein by reference in their entirety.

Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need a novel apparatus and method for altering string tension to control its free vibration frequency is now met by a new, useful, and nonobvious invention.

The novel structure includes a variable tension instrument having a kinetic shape attached to a fixed length string. The kinetic shape has two lateral sides, creating a width and a contacting perimeter, and an aperture through the two lateral surfaces. The aperture is disposed at a predetermined location on the kinetic shape and in an orthogonal orientation with respect to the contacting perimeter. The aperture is adapted to receive an axle around which the kinetic shape may rotate. In addition, a predetermined vertical force is imposed on the axle.

The string has a first end secured at a stationary point and a second end secured to the axle, creating a tension in the string. In an embodiment, the kinetic shape sits atop a moveable platform, such that the contacting perimeter is in contact with the surface of the platform. As the platform is moved, the kinetic shape rotates, thereby altering the tension in the string as the kinetic shape rotates.

In an embodiment, the kinetic shape further includes frequency-identifying indicators around the perimeter. In an embodiment, a second kinetic shape is received by the axle such that the two kinetic shapes are parallel to each other. In a certain embodiment, the contacting perimeter has a nautilus-like shape with respect to an axial viewpoint.

The novel method of using the variable tension kinetic shape string instrument includes securing the first end of the string at a stationary point and securing the second end to an axle passing through the kinetic shape. Additionally a vertical force is applied to the axle, the kinetic shape is oriented into a static equilibrium, and the kinetic shape is then rotated to alter the tension force in the string. The string can then be disturbed to produce a certain frequency based on the tension in the string.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which:

FIG. 3A illustrates how a kinetic shape axle is attached to a string, preventing it from rolling as a vertical weight is applied to its rotation axle.

FIG. 3B illustrates how actively rotating the kinetic shape to a specific position around its perimeter will produce a specified horizontal force (tension), which produces a different frequency.

FIG. 3C illustrates how actively rotating the kinetic shape to a specific position around its perimeter will produce a specified horizontal force (tension), which produces a different frequency.

FIG. 4A depicts the derived kinetic shape in Cartesian coordinates.

FIG. 4B depicts the derived kinetic shape in Polar coordinates.

DETAILED DESCRIPTION OF THE INVENTION

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes a novel variable tension string instrument and method of use. The instrument includes a kinetic shape that actively changes the tension of a string having a constant length and linear density to produce varying vibration frequencies. Hereinafter the term "string" refers to anything resembling a cord or thread, and may be comprised of any material or combination of materials. Additionally, the instrument may include a kinetic shape axle attached to the string, preventing it from rolling as a weight is applied to the kinetic shape's rotation axle. Due to the variable radius of curvature of the kinetic shape, repositioning the kinetic shape will cause different tensions in the taunt string and in turn cause the string to vibrate at different frequencies. Sound is produced by actively rotating the kinetic shape to specific positions around its perimeter to produce a predicted horizontal force (string tension), $F_r(\theta)$, which in turn produces different vibration frequencies when the taut string is plucked.

Kinetic Shape

Figure 1:
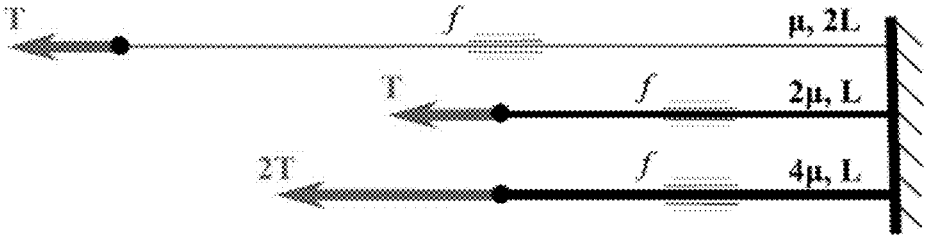
FIG. 1 is a graphical explanation of Equation 1, showing that all three strings will produce the same frequency by varying other parameters.
Figure 2A:
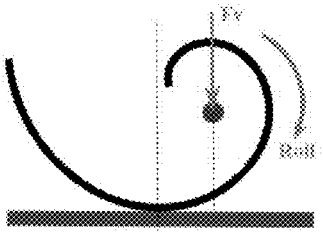
FIG. 2A is an illustration of how a two dimensional, smooth, rounded, and non-circular shape will roll when placed onto a horizontal surface due to the shape's applied weight horizontally misaligning with the ground contact point.

A two dimensional, smooth, rounded, and non-circular shape will roll when placed onto a horizontal surface. This rolling motion is due the shape's applied weight not lining up with the ground contact point, as seen in FIG. 2A. As one applies more vertical downward force onto the shape rotational axis, the tendency to roll increases (rolling force increases).

Figure 2B:
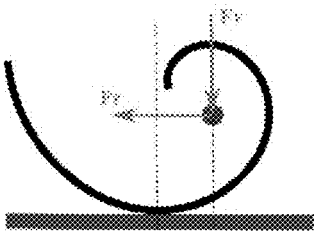
FIG. 2B is an illustration of how the two dimensional, smooth, rounded, and non-circular shape of FIG. 2A will not roll when placed under a horizontal force to maintain static equilibrium.

Assuming that the rolling motion is restricted by a horizontal force such that the shape does not roll and is in static equilibrium (FIG. 2B), the horizontal force to keep the shape from rolling is dependent on the applied vertical force and on the form of the shape. The 2D kinetic shape equation (Equation 2) is shown below:

$$R(\theta) = \exp\left[\int \frac{F_r(\theta)d\theta}{F_v(\theta)d\theta} + \text{constant}\right] \tag{2}$$

where $R(\theta)$ is the radius function that describes the shape in polar notation, $F_v$ is the vertical force applied to the shape axle, and $F_r$ is the horizontal force produced by the shape (tendency to roll). So given a constant vertical force (weight) applied to the shape's rotational axis, it is possible to derive a shape, $R(\theta)$, to produce desired horizontal forces throughout the shape at different angles.

In addition to Equation 2, it is also possible to specifically relate a keynote number to a note frequency. Keynote numbers are the conventionally designated numbers to key frequencies. For example, the note A0, which sounds at a frequency of 27.5 Hertz, has a keynote number of 1, while the note G#4 has a frequency of 415.3 Hertz and is referred to as keynote number 48. The relation between frequency (f) and keynote number (k) is shown below in Equation 3.

$$f = 2^{\frac{k-49}{12}} * 440 \text{ (Hertz)} \tag{3}$$

The kinetic shape and string acoustic concepts discussed above can be combined to actively change the tension of a constant length string with constant unit mass and in turn produce various vibration frequencies. This is possible if a kinetic shape axle is attached to a string, preventing it from rolling as a vertical weight is applied to its rotation axle.

The kinetic shape is actively rotated to specific positions around its perimeter to produce a specified horizontal force (tension) (Fr), which in turn produces different frequencies (FIGS. 3A, 3B, and 3C). Note that the horizontal force ($F_r$) is the string tension (T).

To correlate the shape form function, R(θ), string tension, T, and keynote number (k), $F_r$ in Equation 1 is defined in Equation 2 by T, which in turn is defined by combining Equations 2 and 3. This horizontal force function (tension function) is presented in Equation 4 below:

$$F_r(\theta) = \mu\left[880\ \mathrm{L}\ 2^{\frac{k-49}{12}}\right]^2 \tag{4}$$

where keynote number, k, is a discrete range of keynote numbers (i.e. 50 to 61). The weight function applied to the rotational axle ($F_v$) is a constant weight. Equation (4) can also be presented as a continuous function between an initial and final keynote n times around the kinetic shape.

$$F_r(\theta) = \mu\left[880\ \mathrm{L}\ 2^{\frac{\frac{\theta}{2\pi n}(k_f-k_i)+(k_i-49)}{12}}\right]^2 \tag{5}$$

To obtain the form of the kinetic shape, the tension function and a constant weight, W, as $F_v(\theta)$ are plugged into Equation (2).

$$F_r(\theta) = \exp\left[\int \frac{\mu\left[880\ \mathrm{L}\ 2^{\frac{\frac{\theta}{2\pi n}(k_f-k_i)+(k_i-49)}{12}}\right]^2}{W} d\theta + \text{constant}\right] \tag{6}$$

Solving the indefinite integral yields Equation (7).

$$R(\theta) = \exp\left[\frac{12\pi n 880^2 L^2 \mu 2^{\frac{\theta(k_f-k_i)}{12\pi n} + \frac{k_i-49}{6}}}{W[k_f \ln(2) - k_i \ln(2)]} + \text{constant}\right] \tag{7}$$

Given an initial shape radius, $R(\theta)=R_i$, the integration constant can be solved and the final kinetic shape definition is obtained.

$$R(\theta) = R_i \exp\left[\frac{12\pi n 880^2 L^2 \mu\left(2^{\frac{k_i-49}{6}}\right)\left(2^{\frac{\theta(k_f-k_i)}{12\pi n}} - 1\right)}{W[k_f \ln(2) - k_i \ln(2)]}\right] \tag{8}$$

Equation (8) defines a continuous radius of a kinetic shape from zero to 2πn, where given string parameters (L, μ), initial and final keynote numbers ($k_i$, $k_f$), and an applied constant weight (W) at the shape axle, the kinetic shape will produce adequate string tension to provide the desired keynote string vibration frequencies since keynote angular positions are distributed around the derived kinetic shape. For a kinetic shape of n revolutions (0-2πn), discrete keynotes angular positions Ok are found using Equation (9), where $k_i<k<k_f$ and k is a natural number.

$$\theta_k = (k - k_i)\frac{2\pi n}{k_f - k_i} \tag{9}$$

For example, on a kinetic shape that covers one revolution (n=1) for initial keynote $k_i$=10 to final keynote $k_f$=20, keynote k=15 is found at angular position $\theta_k=\pi$.

Example of the Present Invention:

Kinetic Shape Design and Fabrication

The 2D kinetic shape equation (Equation (2)) indicates that the total dimensions of a kinetic shape are irrelevant, while only the curvature of the shape contributes to its behavior. Given all parameters, Equation (8) allows for the design of a kinetic shape that produces a specified range of string vibration frequencies with adequate total shape dimensions.

For adequate accuracy, the final kinetic shape, and (in turn) instrument dimensions, parameters presented in Table 1 were selected. The selection of these parameters was a process of trial and error using Equation (8) to determine the necessary range to play certain melodies. For example, in order to achieve the same keynote frequency range, choosing a lighter applied weight, longer string length, or heavier string would yield a larger radius change around the kinetic shape and vice versa. Note that the parameters chosen could be adjusted to cover different frequency ranges or to yield any overall size kinetic shape.

TABLE 1

Parameters used to derive the instrument's kinetic shape.

| | |
|---|---|
| Shape initial radius ($R_i$) | 2.5 in. (6.35 cm) |
| Revolutions (n) | 1 |
| Applied weight ($F_V$) | 82 lbf (365 N) |
| String length (L) | 18 in. (45.7 cm) |
| String linear density (μ) | 0.0002159 lbm/in. (0.00003856 kg/cm) |
| | Guitar string type: D'Addario NW034 |
| Initial keynote ($k_i$) | 19 (D#2/77.8 Hz) |
| Final keynote ($k_f$) | 31 (D#3/155.6 Hz) |

Figure 4C:
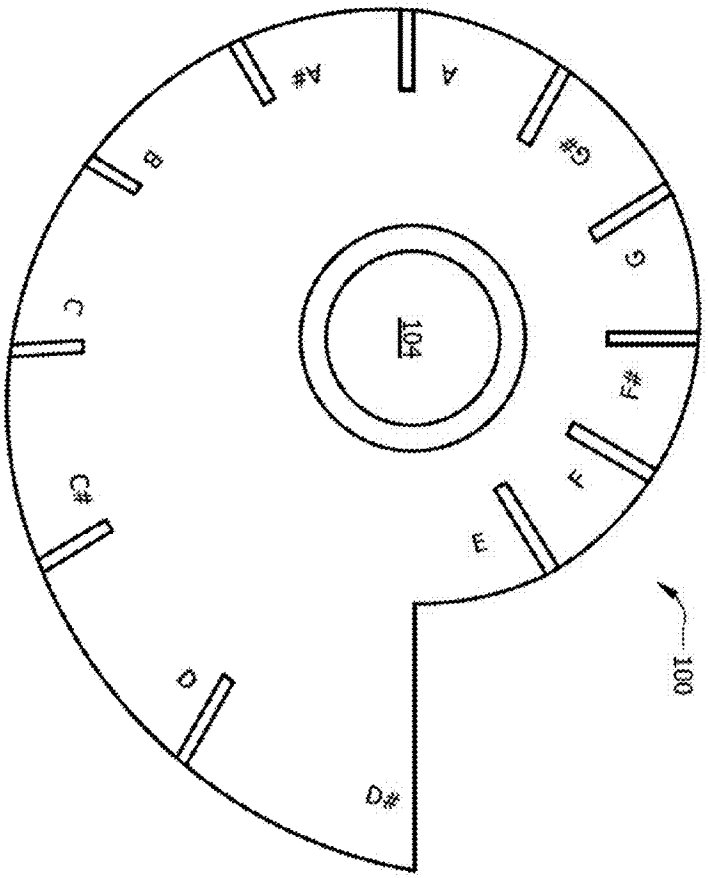
FIG. 4C is a perspective view of the kinetic shape.

These chosen parameters are entered into Equation (8) to generate kinetic shape 100 shown in FIG. 4C. Note that it is possible to derive a kinetic shape for more than one revolution (n>1), however, the curved rolling surface in such a case would be more difficult to access with a flat and tangent surface. In addition, unless specially fabricated, such a resulting kinetic shape could result in a less rigid structure. For ease of fabrication, robustness, and convenience, a kinetic shape that spans across one revolution (n=1) was chosen. Inserting parameters of Table 1 into Equation (5), we find that the string tension around the derived kinetic shape spans from 19.5 N ($k_i$=19) to 78.0 N ($k_f$=31). Note that the shape has specific discrete points around its perimeter, that when placed on these locations and loaded with the specified weight, the string will sound with the designated keynote frequency. Based on equation (4) and other selected parameters, other shapes can be produced that generated different frequencies and ranges using this method.

For experimental purposes, the chosen two-dimensional kinetic shape was laser cut from a 0.375 inch (0.9525 cm) thick sheet of tough acetal resin plastic. After cutting, the rolling surface of the kinetic shape was carefully sanded smooth to reduce any surface imperfections.

Kinetic Shape Reorientation

The derived kinetic shape has to be re-orientated in a simple and accurate manner onto discretely defined points around the shape perimeter. Instead of repositioning the kinetic shape with respect to ground, a platform beneath the shape is moved, thus rolling the shape into position. To minimize error due to slippage between the kinetic shape's rolling surface (or contacting perimeter) and the moving platform surface, the platform and/or the perimeter of the kinetic shape may include a rough surface to prevent slippage of the kinetic shape on the surface of the moving platform. An embodiment may include the kinetic shape and platform mechanically engaged to allow for fluid rotation of the kinetic shape without slippage. To ensure accuracy, the movable platform beneath the kinetic shape is actuated with a stepper motor. An embodiment of the setup is shown in FIG. 5.

Figure 5A:
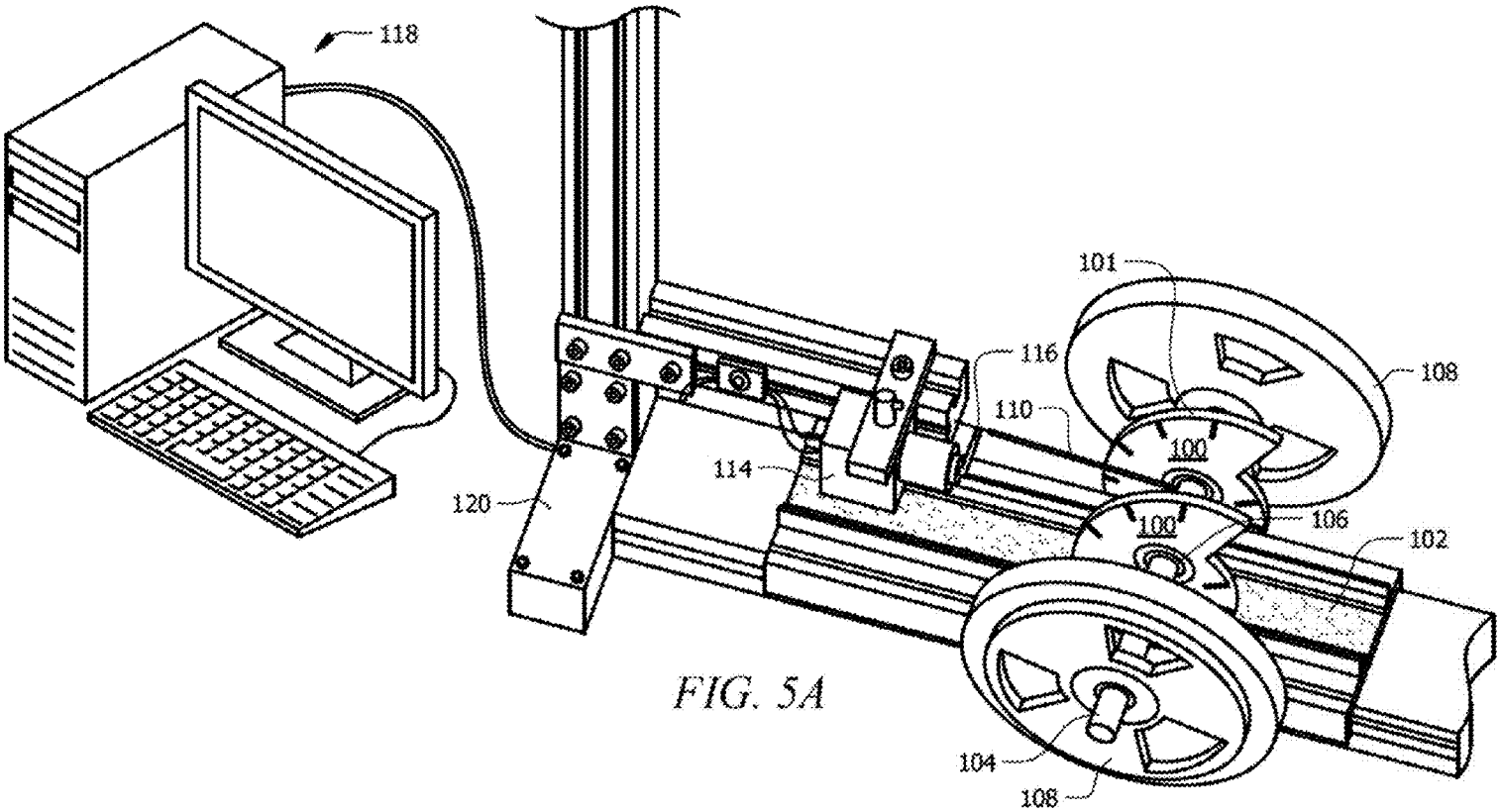
FIG. 5A is a perspective view of a certain embodiments of the present invention.
Figure 5B:
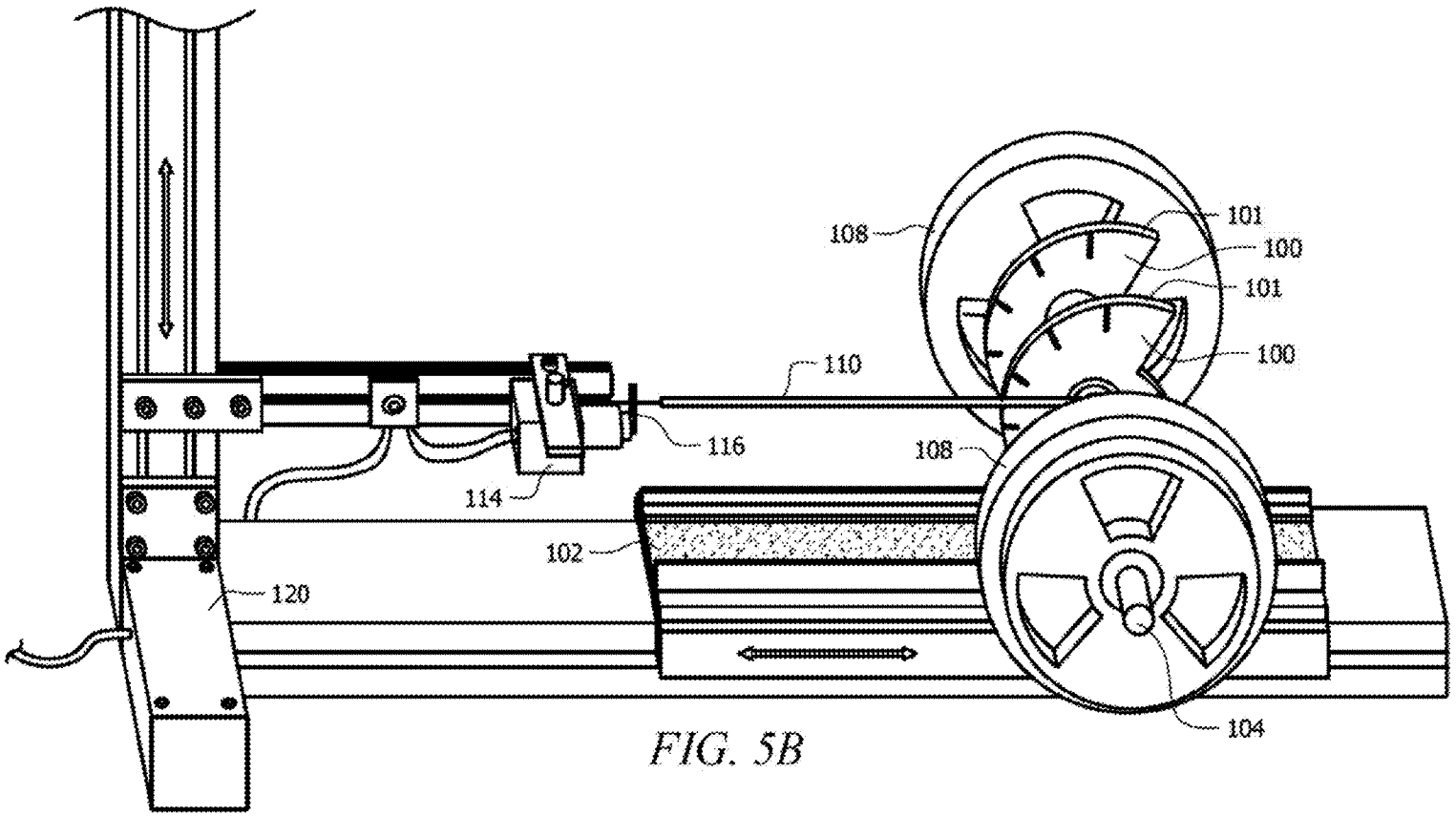
FIG. 5B is a side perspective view of FIG. 5A.

As shown in FIG. 5, two kinetic shapes 100 are configured in a vertical and parallel orientation, where each includes contacting perimeter 101 disposed on moving platform 102. Axle 104 passes through apertures 106 in kinetic shapes 100 and includes weights 108 acting as the constant vertical force. String 110 is secured to axle 104 and stationary point 112. Additionally, servomotor 114 is in communication with pick 116 and secured in a location allowing pick 116 to contact string 110 when motor 114 rotates pick 116.

The instrument is controlled by computer 118 in communication with platform motor 120 and servomotor 114. Computer 118 is easily programmed to translate platform 102, using platform motor 120, to rotate kinetic shapes 100 into any position, therefore, producing specified notes. By moving platform 102 and plucking string 110, songs can be played using this unique and novel instrument. Although obvious applications of this invention lie in musical acoustics, applications may also include in-force sensing through vibration analysis.

Figure 6:
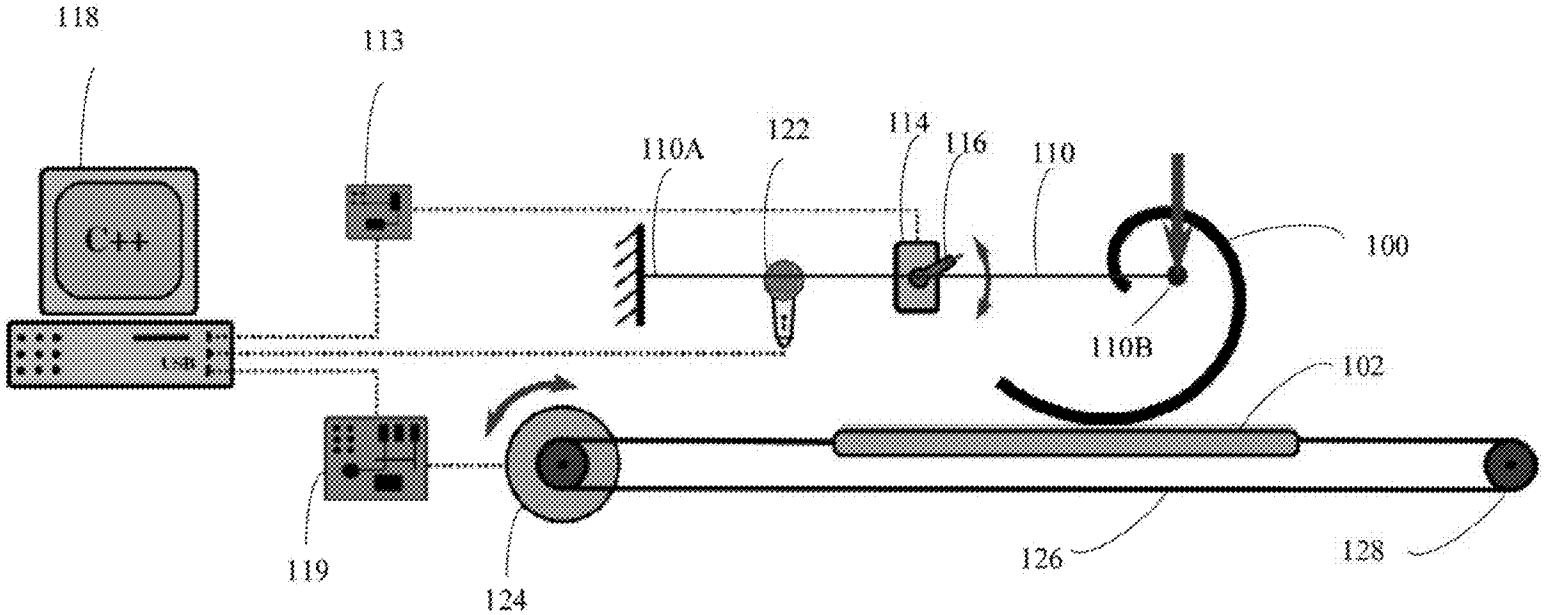
FIG. 6 is a schematic diagram of an embodiment of the present invention.

A schematic of an embodiment of this setup is shown in FIG. 6. Computer 118 is in communication with servomotor control 113 and platform motor control 119. Each control 113, 119 are in communication with their respective motors 114, 120. Stepper motor (or platform motor) 120 is firmly mated to timing belt pulley 124 that moves tightened timing belt 126. Belt 126 loops around idler pulley 128 to move platform 102 linearly on a smooth linear bearing. Additionally, this embodiment includes microphone 122 for recording the sound produced from pick 116 striking string 110. String 110 is set at a known constant length (L), while the known vertical weight ($F_v$) is applied at the shape axle.

The stepper motor is sized so that it can overcome the highest system torque, which is where the kinetic shape exerts the highest horizontal ground reaction force onto the movable platform ($\theta=2\pi$ or D#3). A bipolar hybrid stepper motor with a 1.8° resolution was used during experimentation. However, in the final design stages an extension spring in-line to the movable surface was added to provide additional force along with the stepper motor. The stepper motor was controlled by a board that was interfaced with a computer program on a personal computer via USB.

Note that even without an electric motor it is easily possible to reorient the kinetic shape with the described setup by manually sliding the movable platform beneath the kinetic shape.

Loading the Kinetic Shape

Figure 7A:
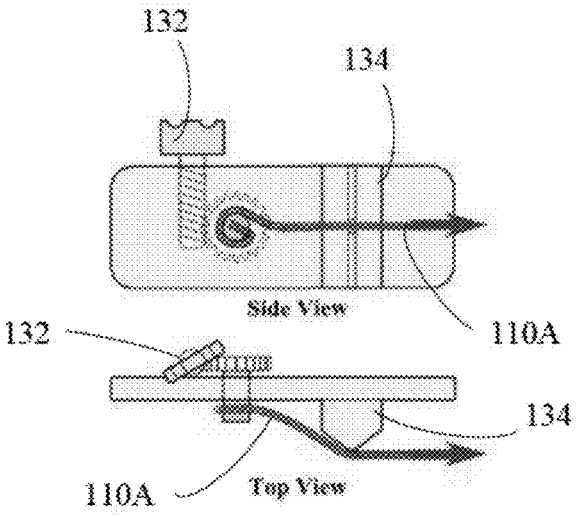
FIG. 7A illustrates a certain embodiment of the connection of the string to the machine head.
Figure 7B:
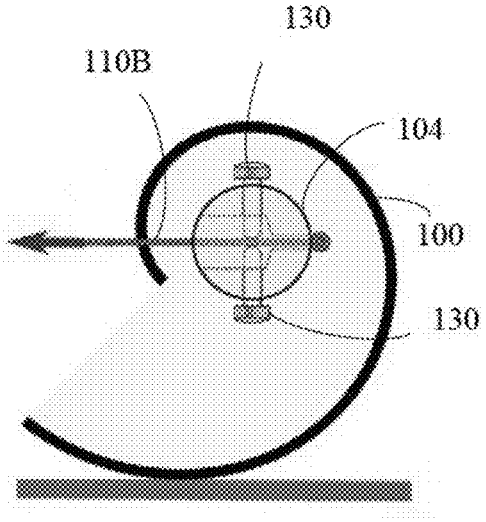
FIG. 7B illustrates a certain embodiment of the connection of the string to the axle.
Figure 7C:
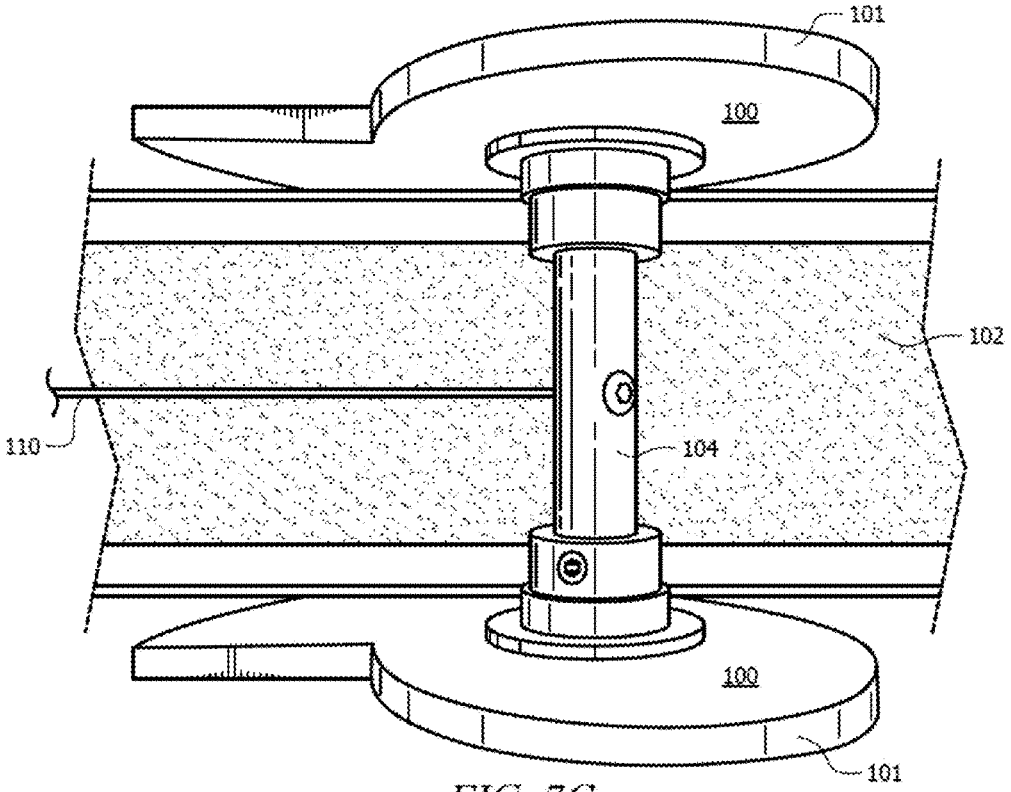
FIG. 7C is a top perspective view of the embodiment in FIG. 5A highlighting the connection of the string to the axle.

For the shape to exert proper and predicted string tension, the applied weight must be distributed onto the kinetic shape itself. In addition, it must exert all ground reaction forces in the direction of the string vector. To alleviate this design constraint, two identical kinetic shapes 100 can be positioned parallel to each other onto axle 104, such as a 1.00-inch aluminum rod with a fixed distance between them. As shown in FIGS. 5 and 7C, both kinetic shapes 100 are held orthogonal with axle 104 and can spin freely around axle 104 via smooth ball bearings (not shown).

After the string is attached, weight is applied to the axle. As shown in FIG. 5, axle 104 can extend out laterally from the external sides of each kinetic shape 100 to provide support members for loading weight 108. For balance, the same amount of weight is placed on both sides. In a certain embodiment, the axle is a single rod and the kinetic shapes are attached to the rod via ball bearings, such that the weights do not rotate as the kinetic shape is rotated into different positions. The prevention of rotation can be achieved through ball bearings in the weight Attaching the String The string is secured at both ends. As shown in FIGS. 7A and 7B, the two ends 110A, 110B of taut string 110 may be attached in a very similar fashion as a conventional electric guitar. The string's peg end (second end 110B) is attached midway between the two parallel kinetic shapes 100. Second end 110B is pulled through a hole in the center of axle 104, while it is held at rod center by two opposing set bolts 130 as seen in FIG. 7B. First end 110A is attached to a machine head (tuner, gear head) set 132 at a fixed distance from kinetic shape axle 104. As shown in FIG. 7A, string 110 passes over elevated bridge 134 and can be adjusted in length by the machine head 132 for frequency calibration purposes. Before usage, the kinetic shape may need to be repositioned a number of times, dynamically loading and unloading the string, before the string assumed steady state length and tension.

String Plucking

In an embodiment, the string is plucked by an extra light/thin nylon guitar pick (0.44 mm), attached to a limited rotating servomotor that is held in position by an adjustable bracket. This servomotor is controlled by a servo controller board that is interfaced with a computer program on a personal computer via USB. The schematic of this setup is shown in FIG. 6. The plucking or disturbance of the string may be accomplished through any automated or manual process known to a person having ordinary skill in the art.

Sound Recording and Analysis

To verify and amplify the oscillation frequency of the string as the kinetic shape is reoriented, microphone 122 may be placed in close proximity along string 110 to record emitted sound frequencies as shown in FIG. 6. The frequency range of the system is targeted at a frequency range from 77.8 Hz to 155.6 Hz, so a microphone should be operational within that range. After the string is plucked, the audio signal is recorded, and a computer program can compute the fast Fourier transform (FFT) while extracting the string's fundamental oscillation frequencies in real time.

Playing a Melody

The computer program can also be programmed to reorient the kinetic shape to manually or automatically play keynote frequencies in a linear succession with a specified rhythm by taking into account the time it takes to reposition the shape. The instrument is also able to play vibratos by simply rocking the kinetic shape back and forth, increasing and decreasing the tension in the taut string.

Experimental Results

Figure 8:
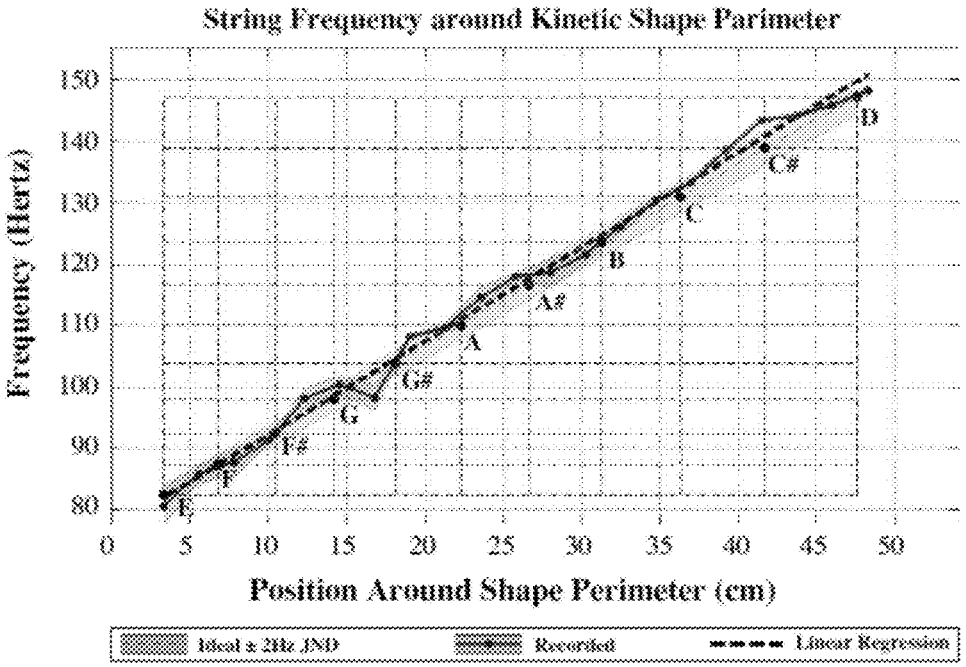
FIG. 8 is a graph showing the results of a guitar string plucked at twenty different positions around the kinetic shape while the string vibration frequency was recorded. The shaded band is the standard deviation of all readings at that particular position.

Once the musical kinetic shape string prototype instrument was assembled and dynamically loaded, it was calibrated to known frequencies around the kinetic shape by slightly lengthening or shortening the guitar string. After calibration the shape was automatically oriented from $\theta=\pi/6$ (E2) to $\theta=11\pi/6$ (D3) at 20 even intervals. $\theta=0$ (D#2) and $\theta=2\pi$ (D#3) were not tested. At each step, the string was plucked ten times with three seconds between plucks, while the dominant string oscillation frequency was recorded at each pluck. After ten plucks the average and standard deviation for one shape orientation was computed and the stepper motor moved the shape into the next orientation. FIG. 8 shows the recorded frequencies as a function of positions around the kinetic shape's perimeter.

As a standard, the frequencies were compared to expected frequencies with an offset of the human ear's just noticeable difference (JND) for pitch. JND (or differential threshold) of the ear is the smallest detectable difference in pitch that the human ear can detect. Although this JND varies depending upon frequency, sound level, and sound duration, the JND for frequencies below 500 Hz is generally found to be 2 Hz.

Despite that the recorded frequencies around the kinetic shape vary slightly from ideal, they are mostly within the JND range. That is, the average human ear could not detect the difference between ideal frequency and the frequency produced by the instrument. The jumps and variations in recorded frequencies can be accounted by imperfections in surface contact between the kinetic shapes and the movable platform and slight misalignment between the two parallel kinetic shapes.

Figure 9:
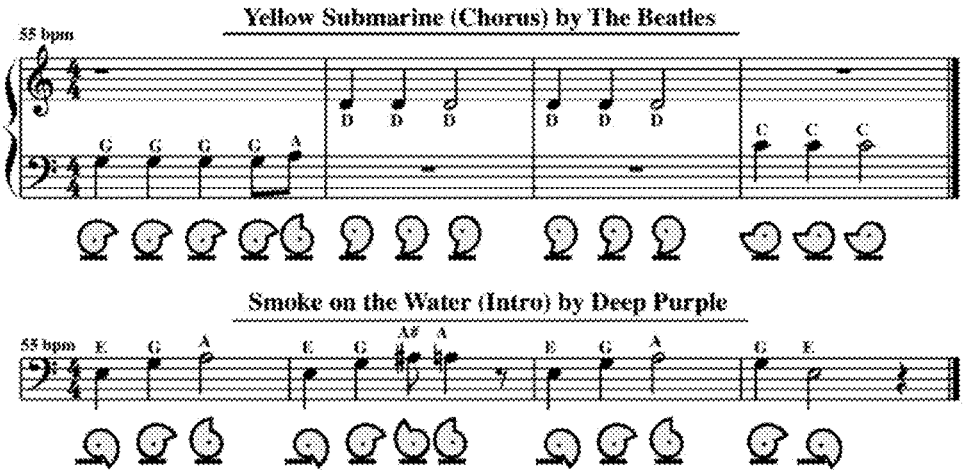
FIG. 9 depicts the melodies on which the present invention was tested.

Since the constructed prototype instrument is able to play melodies that include available notes E; F; F#; G; G#; A; A#; B; C; C#, and D, two melodies were chosen that include these notes to be played by the musical kinetic shape prototype instrument. The chosen melodies are presented in FIG. 9. Melodies were played at 55 bpm, which is roughly half of the songs' original playing tempo to prevent any slippage during this experimental phase.

Although the melodies were played at half tempo, the notes were precisely timed and played at the correct frequency throughout the two melodies. It is interesting to note that after a longer period of experimentation, the instrument had to be calibrated due to contact surface slippage, but adding a feedback controller would allow the instrument to be continuously calibrated in real time.

A certain embodiment may use any method known in the art for decreasing slippage between the contact surface and the kinetic shape, such as a gear assembly or coating the movable platform with higher friction material.

A certain embodiment may have two or more strings with corresponding kinetic shapes parallel to each other reoriented independently and played simultaneously to allow for more complicated and faster melodies and even chords. For example, as one string-shape is being played other string-shapes rotate into position for upcoming notes. Although the design embodies a string that is being plucked, it is also possible to have the same instrument by bowing the string in variable tension. Furthermore, a certain embodiment may have a greater range by using a kinetic shape with more than one revolution, or even a 3D kinetic shape that is attached to two string with two independent tensions.

Although this invention is used to generate music, the same concept can be applied to manufacture strain gages that have adjustable sensitivity. This could be done by placing the kinetic shape into a soil, concrete, or other medium such that the deformed medium applies a force onto the shape, which tightens or loosens a vibrating wire.

REFERENCES

Ismet Handžić, Kyle B. Reed. The musical kinetic shape: A variable tension string instrument. Applied Acoustics 85 (2014) 143-149.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A variable tension instrument comprising:

a kinetic shape object, wherein the kinetic shape object further includes:

two lateral sides creating a width and a contacting perimeter;

an aperture through the two lateral surfaces at a predetermined location on the kinetic shape object and in an orthogonal orientation with respect to the contacting perimeter of the kinetic shape object, wherein the aperture is adapted to receive an axle;

a string having a first end and a second end, wherein the first end is secured at a stationary point and the second end is secured to the axle thereby creating a tension in the string;

a predetermined vertical force imposed on the axle;

a platform on which the contacting perimeter of the kinetic shape object is disposed; and the kinetic shape object rotatable about the axle, thereby altering the tension in the string as the kinetic shape object rotates.

2. The variable tension string instrument of claim 1, wherein the kinetic shape object further includes frequency-identifying indicators around the perimeter.

3. The variable tension string instrument of claim 1, further comprising a second kinetic shape object receiving the axle such that the two kinetic shape objects are parallel to each other.

4. The variable tension string instrument of claim 1, wherein the contacting perimeter has a nautilus-like shape with respect to an axial viewpoint.

5. The variable tension string instrument of claim 1, further comprising:

a second kinetic shape object, wherein the second kinetic shape object further includes:

two lateral sides creating a width and a contacting perimeter;

an aperture through the two lateral surfaces at a predetermined location on the second kinetic shape object and in an orthogonal orientation with respect to the contacting perimeter of the second kinetic shape object, wherein the aperture is adapted to receive a second axle;

a second string having a first end and a second end, wherein the first end is secured at a stationary point and the second end is secured to the second axle thereby creating a tension in the second string;

a predetermined vertical force imposed on the second axle;

a platform on which the contacting perimeter of the second kinetic shape object is disposed; and the second kinetic shape object rotatable about the second axle, thereby altering the tension in the second string as the second kinetic shape object rotates.

6. A method of using the variable tension kinetic shape string instrument comprising:

securing a first end of a fixed length string at a stationary point;

securing a second end of the string to an axle passing through a kinetic shape object, the kinetic shape object further including:

two lateral sides creating a width and a contacting perimeter; and an aperture through the two lateral sides at a predetermined location on the kinetic shape object and in an orthogonal orientation with respect to the contacting perimeter of the kinetic shape object, wherein the aperture is adapted to receive an axle;

applying a vertical force on the axle;

orienting the kinetic shape object, such that a tension force in the string and the vertical force on the axle allow the kinetic shape object to rest in a static equilibrium;

rotating the kinetic shape object, such that the tension force in the string changes; and producing a vibration in the string creating varying frequencies based on the tension in the string.

7. The method of claim 6, wherein the contacting perimeter has a nautilus-like shape with respect to an axial viewpoint.

8. The method of claim 6, wherein the step of rotating the kinetic shape object further includes a moveable platform on which the contacting perimeter of the kinetic shape object is disposed, such that movement of the platform rotates the kinetic shape object.

9. The method of claim 6, wherein the steps of rotating the kinetic shape object and contacting the string further include using an automated machine to rotate the kinetic shape object and to contact the string.

10. The method of claim 6, further comprising:

securing a first end of a second fixed length string at a stationary point;

securing a second end of the second string to a second axle passing through a second kinetic shape object, the second kinetic shape object further including:

two lateral sides creating a width and a contacting perimeter; and an aperture through the two lateral sides at a predetermined location on the second kinetic shape object and in an orthogonal orientation with respect to the contacting perimeter of the second kinetic shape object, wherein the aperture is adapted to receive a second axle;

applying a vertical force on the second axle;

orienting the second kinetic shape object, such that a tension force in the second string and the vertical force on the second axle allow the second kinetic shape object to rest in a static equilibrium;

rotating the second kinetic shape object, such that the tension force in the second string changes; and producing a vibration in the second string creating varying frequencies based on the tension in the second string.

11. The method of claim 6, further comprising measuring force or stress in the string by relating string frequency to the vertical force.

12. A kinetic shape instrument, comprising:

two lateral sides creating a width and a contacting perimeter, wherein the contacting perimeter has a nautilus-like shape; and an aperture through the two lateral surfaces at a predetermined location on the kinetic shape instrument and in an orthogonal orientation with respect to the contacting perimeter of the kinetic shape instrument, wherein the aperture is adapted to receive an axle.

13. The kinetic shape instrument of claim 12, further including being rotatable about the axle.

14. The kinetic shape instrument of claim 12, further including a predetermined vertical force imposed on the axle.

15. The kinetic shape instrument of claim 12, further including a string having a first end and a second end, wherein the first end is secured at a stationary point and the second end is secured to the axle thereby creating a tension in the string.

16. The kinetic shape instrument of claim 12, further including frequency-identifying indicators around the contacting perimeter.

* * * * *